United States Patent [19]

Cohen et al.

[11] Patent Number: 5,033,668

[45] Date of Patent: Jul. 23, 1991

[54] FOLDABLE CONTAINER AND METHOD FOR MAKING THE SAME

[75] Inventors: Laura L. Cohen, Akron; Roy M. Kay, Monteville, both of Ohio

[73] Assignee: Flatwrap, Inc., Akron, Ohio

[21] Appl. No.: 357,033

[22] Filed: May 25, 1989

[51] Int. Cl.[5] ..... B65D 5/24

[52] U.S. Cl. ..... 229/186; 229/120.12; 229/125.39; 229/922

[58] Field of Search ..... 206/521, 586, 591; 229/40, 186, 120, 12, 120.18, 922, 923, 125, 37, 125.38, 125.39

[56] References Cited

U.S. PATENT DOCUMENTS

| | | | |
|---|---|---|---|
| 635,349 | 10/1899 | Reber | 229/125.39 |
| 1,020,878 | 3/1912 | Bendelari | 229/120.18 |
| 1,155,686 | 10/1915 | Rhodes | 229/125.38 |
| 1,687,678 | 10/1928 | Mallory | 229/186 |
| 1,699,008 | 1/1929 | Miller | 229/186 |
| 1,727,435 | 9/1929 | Kopple | 29/125.38 |
| 1,760,106 | 5/1930 | Beach | 229/40 |
| 1,833,492 | 11/1931 | Miller | 229/186 |
| 2,792,165 | 5/1957 | Thompson | 229/186 |
| 3,627,541 | 12/1971 | Farguhar | 229/40 |
| 4,809,907 | 3/1989 | Langer | 229/186 |

FOREIGN PATENT DOCUMENTS 164795 12/1985 European Pat. Off. ..... 229/120.12

*Primary Examiner*—Gary E. Elkins

*Attorney, Agent, or Firm*—Oldham & Oldham Co.

[57] ABSTRACT

A container assembly which is especially adaptable to form a final presentation enclosure is constructed from a flat blank of material. The flat blank is provided with a plurality of fold lines forming a bottom wall, side walls, and top wall portions which act in conjunction with one another to enclose a space. The side walls are connected by joining portions constituting bellows-type folding members. The container is constructed by initially folding. The joining members are folded inwardly thereby drawing up the respective side walls to which they are attached. The container does not utilize tabs, glue or other fastening arrangements normally associated with a variety of containers. The top walls are formed so as to be exposed at the top of the container to allow securing of the top wall portions by any suitable means. There is also provided a variable volume container by means of the joining members which extend into the interior of the container. The joining members act to center and protect a smaller item within the container or can be completely moved to make available the total volume of the container.

14 Claims, 4 Drawing Sheets

FOLDABLE CONTAINER AND METHOD FOR MAKING THE SAME

BACKGROUND OF THE INVENTION

This invention generally relates to an improved container constructed by folding a flat blank to form a decorative or non-decorative container assembly having a unique appearance and advantages. In particular, the container of the present invention is quickly and easily formed into a finished presentation enclosure from an initially non-folded blank in such a way that the natural human movements are utilized in the construction. The formed enclosure provides a simple yet durable construction which may be advantageously decorated by a variety of techniques to yield an aesthetically pleasing appearance and construction.

There are known in the prior art a variety of containers, such as the conventional card board box or the like. The standard box is formed in a rolled construction such that two ends thereof are secured to one another and subsequently folded to a flat position for shipping and handling until use. These containers must be made of a strong material and are normally stored in a folded condition which may create deterioration of the material at the fold lines and subsequent cracking or tearing of such material. Other constructions may use a flat blank material having fold lines formed therein which will subsequently be folded to its desired shape. Several examples of these type of containers may be found in U.S. Pat. No. 3,373,922 and U.S. Pat. No. 2,563,619 showing containers particularly constructed for holding and serving food type products. In U.S. Pat. No. 3,373,922, the flat blanks used in the construction of the container are noted to be initially preassembled by folding sides of the container to their erect positions such that closure tabs may be glued or fastened to an adjacent side wall. The container then includes fold lines to allow folding the preassembled container to a somewhat flat position similar to that of a common card board box or the like. It is noted that in the construction of the container there are necessarily formed closure tabs, inserts or hooks which must be painstakingly physically coupled with each other, or by the use of glue or other fastening means.

It should be recognized that the provision of closure tabs, inserts or the like make construction of the container much more complicated and time consuming and many times will include complicated folding techniques hindering use of the container. Another foldable container is seen in U.S. Pat. No. 4,809,907, wherein a blank of material includes a large number of fold lines to form reinforced sides and bottom areas as well as a top portion which includes engaging tabs to secure the top portion with the container. This container also includes joining elements which are made to overlap the inner surfaces of respected side portions to which they are attached. It should be recognized that the construction of the container in this invention requires a multitude of folds to be formed in the container for proper functioning rendering use thereof somewhat inconvenient and cumbersome.

SUMMARY OF THE INVENTION

Based on the foregoing, there has been found a need to provide a container assembly which may be easily and quickly folded from a flat blank of material to form a durable and aesthetically pleasing container having unique characteristics. It has been found that in many situations in which containers are to be used, the provision of closure means such as tabs, slots, inserts, hooks or the provision of adhesives or the like are not necessary and simply burden the construction of the container and add to the cost thereof. For example, a gift which is to be given for special occasions, such as a birthday or at Christmas, is normally placed into a box or the like and subsequently wrapped with wrapping paper to give a decorative appearance to the box. Subsequently, a greeting card or the like is placed with the wrapped package and a bow or other decorative device may be placed thereon. In any event, under most circumstances, there is already use of some other type of assembly such as a decorative bow, ribbon or merely adhesive tape of some kind used in conjunction with a container.

Thus, the container of the present invention includes no integral closure means, and will take advantage of the conventional use of some other type of assembly which may act as the closure for the container. In this way, a duplication of effort and cost in physically sealing the container is avoided. It is also desirable to form a container in a flat preassembled condition to make packaging, shipping and handling of the container more convenient and cost effective. A further desired attribute for a container is the ability to enable printing or other techniques to be utilized easily and effectively to provide a decorative type container which may preclude use of wrapping paper or the like conventionally used in the past.

It is therefore an object of the invention to provide a container which is formed from a flat blank of material so as to make manufacture, shipping and handling easy, efficient and cost effective.

It is another object of the invention to provide a container which has no integral closure means and is thus simplified in construction and use thereof. The ergonomic construction of the container takes into consideration human parameters such as the average hand span size and the natural tendency to fold the fingers of the hand into the center of the hand in a grasping movement. These natural movements of the users hand permit simple and effective construction of the container.

It is yet another object of the invention to provide a container which may be constructed of a relatively light weight paper material which normally would be too heavy for wrapping paper and too light for boxing materials. The material allows fine precision folding and yet will provide a strong and durable container construction. The container being constructed from a flat blank of material is also uniquely adapted to be printed on one or both sides thereof to form a decorative assembly having a clean and aesthetic appearance.

It is a further object of the invention to provide a container being constructed from a flat blank of material and having a variable sized volume to accommodate different sized articles therein.

It is yet another object of the invention to provide a unique die assembly and method of making the container to provide the advantages thereof.

The container of the invention comprises four side portions as well as a bottom portion, and a plurality of top portions which act in conjunction with one another to form an enclosed top for the container. The first and third side portions oppose one another in the assembly and have disposed on their outer peripheral edges a rectangular component of the top side which extends over approximately half of the top surface of the assembled container. On the second and fourth side members, a triangularly shaped top portion is formed on the peripheral edges thereof and extends over slightly half of the top surface to overlap one another such that all four top members are exposed at approximately the center of the top surface to be secured by any appropriate means such as a decorative bow, label or the like. This is necessary to insure that all four surfaces have maximum exposure to the securing element and thus insures a completely secure construction.

The container also includes joining members coupled to each of the respective side portions to thereby interconnect the side portions. The joining members are provided with a bellows-type fold to be inwardly folded into the interior of the container when assembled so as to provide further support to the top surface, and to provide a variable volume container depending upon their orientation within the container. The container may be made of a variable size from a variety of materials, and is particularly adapted to the usable with a variety of printing techniques to form a decorative container. Of particular importance in the invention is the provision of proper fold lines in the construction to meet very exacting tolerances for proper folding and functioning of the container. A die utilized to form the fold lines in a blank of material having unique capabilities is provided for this purpose.

BRIEF DESCRIPTION OF THE DRAWINGS

These and other objects, advantages and uses of the invention will become apparent from a reading of the following description with reference to the accompanying drawings wherein.

DETAILED DESCRIPTION OF THE INVENTION

Figure 1:
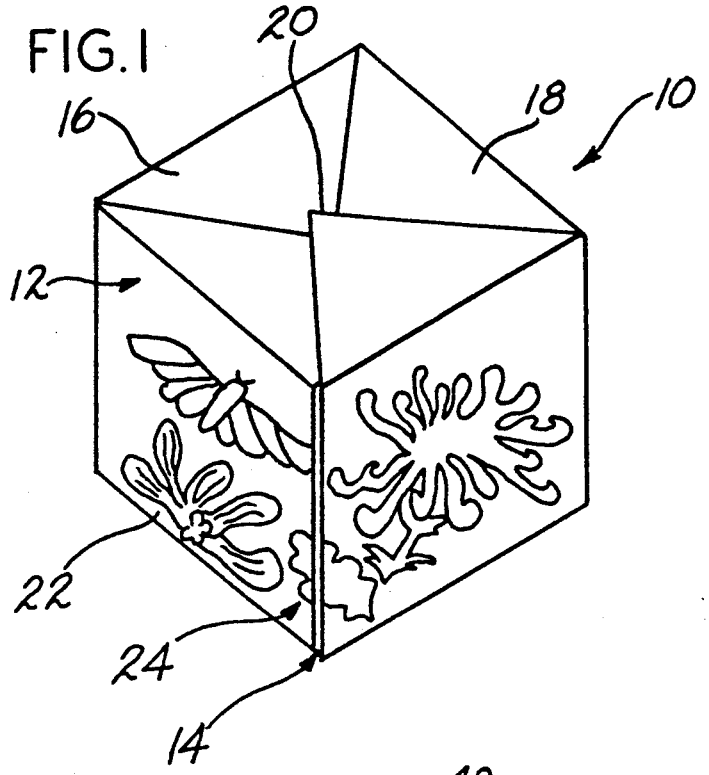
FIG. 1 is a perspective view of the assembled container of the invention.

Turning now to FIG. 1, the container 10 is shown as a final presentation enclosure to fully enclose an item such as a gift or the like. The enclosure 10 includes a plurality of side walls 12 which come together at the edges thereof to form a joint 14 similar to a miter joint yielding a creased edge look like those formed utilizing wrapping paper or the like. The enclosure also includes a unitary bottom as well as the plurality of elements comprising two pairs of opposed elements 16 and 18 which are folded upon one another to form the completely enclosed top for the enclosure 10. The pair of opposing elements 16 are constructed so as to over-lap slightly at 20 such that all four top elements are exposed near the center of the enclosure. The enclosure of the invention does not include any means to secure the side elements or top elements together as conventionally found in the prior art.

It has been recognized that the use of gluing or tabs and inserts or the like to secure the side or top elements together in an enclosure will necessitate the use of additional equipment and/or increase the time and effort needed to construct the enclosure. The final presentation enclosure 10 of the present invention recognizes that conventionally there is provided other means by which the enclosure can be secured from opening. A decorative bow, ribbon or the like may be placed at the center of the top portion of the enclosure 10 and effect securing of the top panel members 16 and 18 together for this purpose. The ease of construction is thereby enhanced, and the enclosure 10 is both cost effective and easily manufactured.

As seen in FIG. 1, the side elements 12 or any of the surfaces of the enclosure 10 may include printed material 22 such that the enclosure 10 acts as a final presentation enclosure for use, as an example, to wrap a gift or the like in one easy step. The enclosure 10 may be formed into the shape as shown in FIG. 1 both quickly and easily and a gift placed inside without the need of further wrapping of the enclosure 10. The ability to print any desired material on the surfaces of the container forgoes the use of wrapping paper. It is noted that the decorative material 22 may have been advantageously printed on the sides or other portions of the enclosure 10 such that a wrap around effect is accomplished by the printing as shown at 24. The joints 14 form a mechanical reproduction of the fold utilized with a fine hand-wrapped package a wrapped package using wrapping paper to yield a very aesthetically pleasing appearance without wasting time or effort with further wrapping conventionally done in the past.

Figure 2:
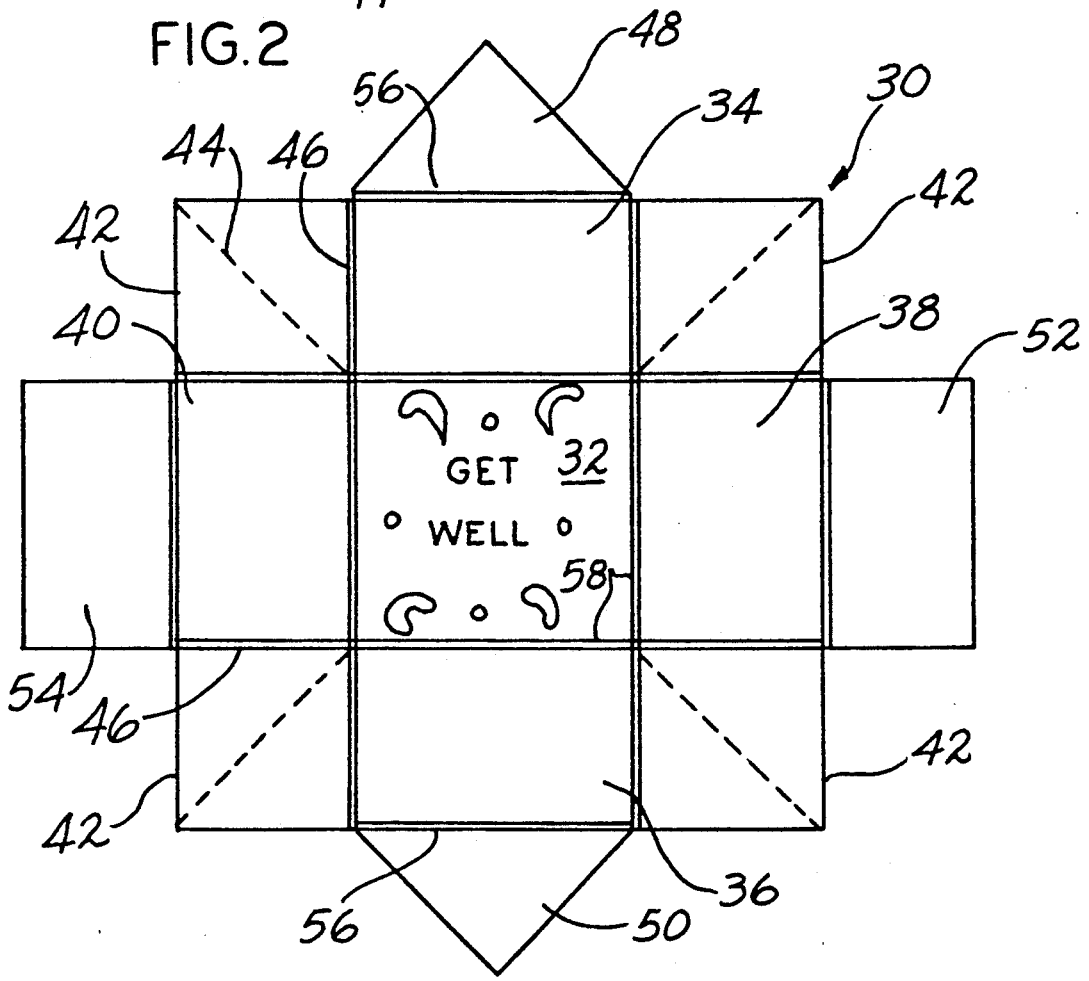
FIG. 2 is a top plan view of a blank of material to form the container illustrated in FIG. 1.

The enclosure 10 as seen in FIG. 1 is constructed from a blank 30 of material as seen in FIG. 2. A bottom panel 32 is surrounded first and third side panels 34 and 36 diametrically opposed adjacent to bottom panel 32 as well as second and fourth side panels 38 and 40 also in opposed positions. The side panel members 34–40 are coupled together by means of bellows-type folding members 42 which will draw the respective side portions 34–40 to a closely adjacent position to form the joint 14 as seen in FIG. 1. The connecting portions 42 include a perforated fold line 44 such that they may be easily creased inwardly during assembly of the container. There are also provided fold lines 46 which are scored zones adjacent each of the side elements 34–40 at the location of the connecting elements 42. The first and third side elements 34 and 36 are coupled with top cover members 48 and 50 and the second fourth side members 38 and 40 are coupled with top cover members 52 and 54 respectively. At the interface of the top cover members 48–54 with the side elements 34–40, there are provided scored fold lines 56 enabling the top cover members 48–54 to be folded into a closed position at the top of the container during assembly.

It has been found to be necessary to provide several combined die techniques to form the fold lines in the blank 30 to enable proper folding and construction of the enclosure of the invention. For example, the different matrices utilized in the die structure of the invention are necessary to provide the proper amount of scoring at the desired thickness to enable proper positioning of the respective side and top elements relative to one another as well as to achieve sharp precision folds. It should be recognized that the top elements must fit very precisely relative to the side elements to maintain the joints 14 as shown in FIG. 1 as well as to form a tightly closed container as desired.

It is also seen in FIG. 2, that the inner surfaces of the blank 30 may be provided with printed material constituting any design which may constitute a greeting card, advertisement or the like. In this way, the final presentation enclosure formed by the blank 30 may be utilized as a gift package having a card appropriate for the occasion printed right on the enclosure for convenience and adaptability of use. The manufacture of the blank 30 to form a final presentation enclosure is found to be particularly adaptable to an in-line process. For example, a roll of stock paper may be run through a conventional printing technique including the ability to manipulate the stock for printing on both sides thereof and subsequently be die cut utilizing the manufacturing die of the invention to form a plurality of final presentation enclosure blanks. The blanks may be subsequently packaged and shipped in their flat condition.

In this way, almost any conventional printing technique may be utilized with the enclosure assembly of the invention including embossing, hot stamping, foil stamping, thermography as well as other conventional techniques. As mentioned, the final presentation enclosure may be provided with a suitable greeting card printed thereon such that a plurality of containers for different occasions may be easily and conveniently packaged together to provide use of the enclosure in a variety of applications. It should also be recognized that different papers may be utilized with the container of the invention, but the construction is particularly applicable for relatively light weight papers. Although light weight papers are preferred, the construction still yields a strong and durable container for its intended use. Alternatively, the construction of the container also allows a broad range of off-line customization including additional printing or other off-line processes conveniently and cost effectively.

It is also a feature of the invention that the enclosure formed from the blank 30 of FIG. 2 as shown in FIG. 1 is ergonomically designed in accordance with the human parameters of users. In one embodiment, the blank 30 is constructed to be the size of an average hand span of the user and has the particular design as shown to accommodate the natural tendency to fold the fingers of the hand to the center of the hand in a grasping motion. During assembly, the connecting elements 42 are folded inwardly by means of the thumb and little finger of the hands on respective sides of the container leaving the three middle fingers and palms of the hand to fold in the side elements adjacent thereto with the connecting elements 42 drawing the other side elements upwardly therewith. The natural tendency of the grasping motion is utilized to easily fold and construct the container of the invention.

Figure 3:
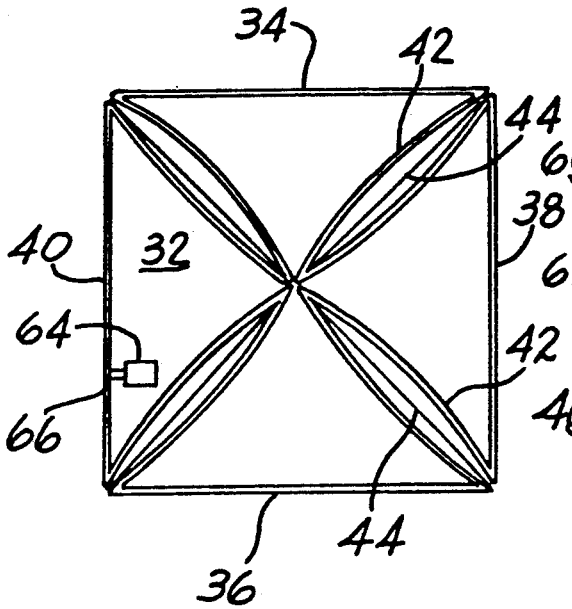
FIGS. 3 and 3*a* show top plan views of the container in its assembled condition with the top portions in their open positions showing the position of the bellows-type joining members within the container.
Figure 3A:
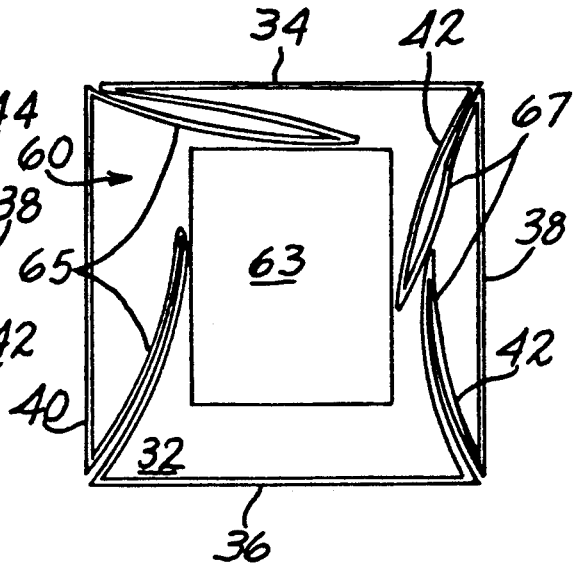
Figure 4:
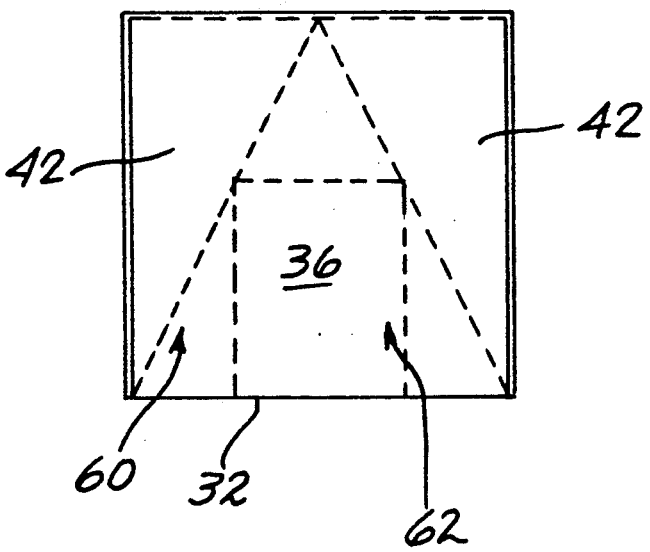
FIG. 4 is a side view of the container further showing the position of the joining members within the container as seen in FIG. 3.

Turning now to FIGS. 3, 3*a* and 4, other advantages of the construction will become apparent. As seen in FIG. 3, wherein like elements are referenced in accordance with FIG. 2, the side elements 34–40 are folded into an upright position around bottom element 32. The connecting elements 42 having perforated fold lines 44 and are thereby inwardly folded to the interior of the space enclosed by side elements 34–40 as shown. Advantageously, the side elements generally extend towards the center of the container initially. As seen in FIG. 4, the connecting members 42 will act to provide further support for the top cover and side members of the construction, and will act to center a smaller sized item 62 in the container for storage. The connecting members 42 reinforce the sides of the assembled container to allow effective storage without the threat of damaging or crushing of the sides.

It is also a feature of the container assembly that a musical chip 64 activated by an extending post or switch 66 may be placed in the enclosure upon assembly. When the enclosure is opened, the switch 66 will be released to initiate the playing of a melody programmed into the chip 64. The chip may be similar to that used in the musical greeting cards.

It should also be recognized, as seen in FIG. 3*a*, that the connecting members 42 act to vary the effective storage volume 60 of the container and as centering means when in their inwardly extending positions. Thus, when an item 63 which has width dimensions smaller than the container is placed in the container, the connecting elements 42 act to retain the item in a centered position within the container by applying a pushing force from connecting elements 42. The elements 42 thereby protect the item by avoiding movement thereof within the container. As the size of the item to be stored in the container increases, the connecting elements 42 will be physically moved from their initial inwardly extending position to a position more closely adjacent one of the side elements to which their attached. The positions of the connecting elements 42 may be on each side of the item 63 as at 65 or acting together on a side of the item 63 as shown at 67 and will still the desired variable volume function. Thus, the container of the invention allows a variable volume to be achieved within the container to accommodate different sized items therein without loss of structural strength.

Figure 5:
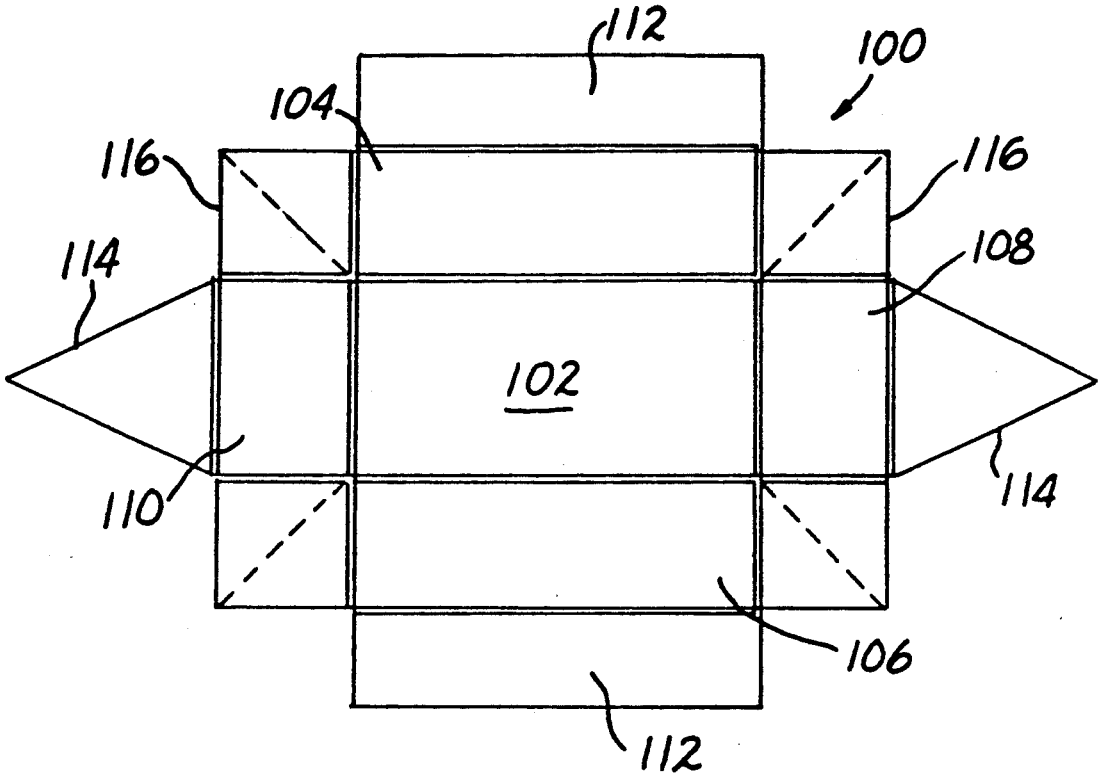
FIG. 5 is a top plan view of a foldable blank to form an alternate embodiment of the container.
Figure 6:
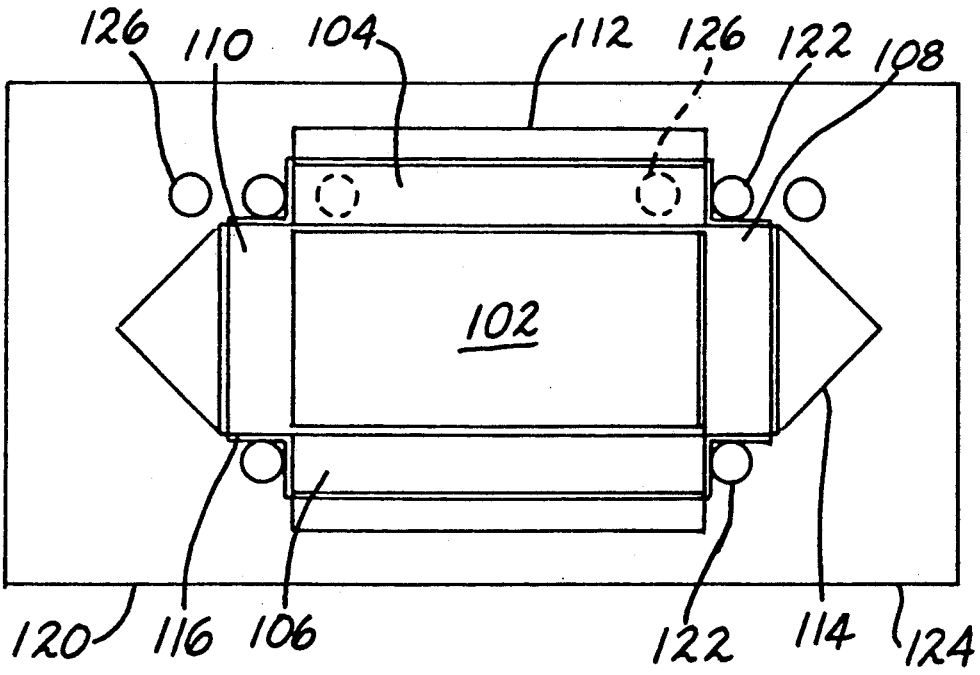
FIG. 6 is a top plan view of the container as shown in FIG. 5 being constructed by use of a folding jig.

Turning now to FIGS. 5 and 6, an alternate embodiment of the invention is shown. A container having larger dimensions to store larger items accordingly, may be formed from a blank 100 as seen in FIG. 5. It should be recognized that the construction is basically similar except that a rectangular container will be formed to store clothing or other items. Again the blank 100 includes a bottom panel 102 having first and third side elements 104 and 106 extending the length of the bottom panel 102. Contrary to the first embodiment, the side elements 104 and 106 have rectangularly shaped top panels 112 on their outer peripheral edges. The top panels 112 have dimensions so as to extend over half the width of the bottom panel 102. The second and fourth side panels 108 and 110 extend the width of the bottom panel 102 and have top panel members 114 coupled to their outer peripheral edges. The triangularly shaped top panel members 114 are dimensioned so as to extend the length of the bottom panel 102 and to slightly overlap similar to that previously described. The triangular portions are positioned in this manner so as to provide a pulling force from the sides 108 and 110 forming a secure and strong construction. The side panels are coupled by means of connecting portions 116 which will be inwardly folded to draw up the respective side elements to which they are attached. It should be recognized that the same basic construction can be utilized with other sized containers as long as the respective side and top elements act to fully enclose the container.

The embodiment of the invention as shown in FIG. 5, being of larger dimension is not designed directly around the human parameters of hand span size and the grasping movement of the hands. A similar effect can be obtained by a folding jig 120 as seen in FIG. 6. The folding jig 120 simple comprises a plurality of posts 122 positioned on a support base 124 so as to extend in an upright position. The posts 122 are positioned so as to contact the connecting elements 116 of the blank 100 as shown in FIG. 5. The posts 122 act as the thumb and little finger of the users hand to inwardly fold the connecting portions 116 and thereby draw up the respective side portions 104–110 to which the respective connecting portions 116 are attached.

As seen in FIG. 6, the connecting portions 116 are folded to a vertical position by the posts 122 to form a semi-folded container assembly. At this point, the side elements 104-110 as well as the top elements 112 and 114 are easily folded into position by a user. Thus, the item to be packaged may simply be positioned on the bottom panel 102 of a flat blank having a construction in accordance with the invention, and merely pushed down between the post 122 of the assembly jig 120 to form a final presentation enclosure assembly housing the item to be packaged. A plurality of different sized containers may be formed by merely repositioning the posts 122 in a variety of holes 126 provided in the support base 124. The use of the assembly jig 120 facilitates easy and efficient assembly of the enclosure by replacing the action of a human hand as previously described.

Turning now the manufacturing die utilized to produce the invention, a multi-operation die 150 is provided which accomplishes a variety of die operations. The die accurately produces a variety of fold lines as well as cutting of a base material to form the blanks utilized in the assembly of the final presentation enclosure. The die includes use of scoring, slitting and perforating rules and the application of both broad and narrow matrices. The die is in effect a double die in that it produces the required reverse series of scores needed to allow proper multiple layer folding without crushing the delicate inside corners of the container assembly. A first set of a plurality of slitting rule members 152 along the outer peripheral edges of the blank are positioned to extend a predetermined depth upon application of the die 150 so as to completely sever the blank from the base material. A series of ejection rubbers 154 are provided for release of the die-cut material after application of the die. A second set of scoring rule members 156 are provided to produce the scored fold lines at the coupling locations of the top elements of the blank. The rule members 156 of the second set enable reverse scoring of these areas such that the top elements will properly fold over the side elements and each other to form a secure and strong construction. A third set scoring of rule elements 158 are provided to produce fold lines at the coupling locations of the side and bottom elements of the blank. The rules 158 produce fold lines scored oppositely to those produced by rules 156. A fourth set of fine tooth perforal rules 160 produce perforated fold lines at a 45 degree angle through the connecting elements. By providing perforations in the connecting elements, these portions are readily folded inwardly to start assembly of the enclosure from the blank.

The manufacturing die 150 also includes the use of matrix tape associated with all of the scoring rules 156 and 158. An example of the matrix tape is shown at 162 which allow the desired amount of scoring to be accomplished by each of the individual scoring rules. It is bee found with the container assembly that the use of both broad and narrow grooved matrix tapes allows proper fold lines to be produced to achieve desired folding characteristics in the final assembly. The matrix tape 162 utilized at the coupling locations of the bottom element are preferably relatively broad channeled to give the fold line greater flexibility and ease folding of the assembly at this location. The fold lines surrounding the side elements of the assembly are preferably comprise narrow channeled matrix tape 162 to achieve crisp flat folding for good sharp edges so as to not create bulges in the corner pocket sections of the assembly. Thus, a plurality of different matrix tapes may be utilized to achieve proper folding characteristics as desired.

Figure 7:
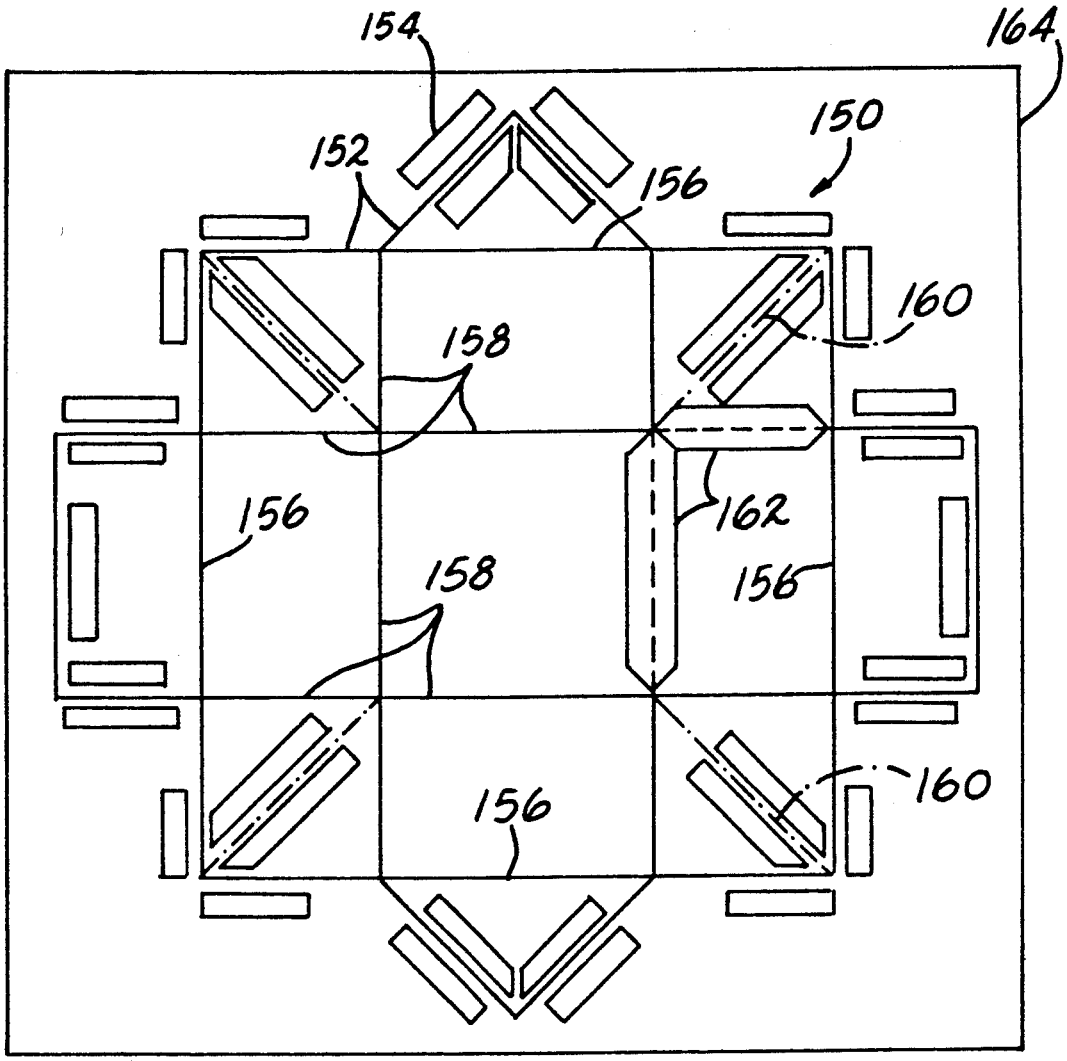
FIG. 7 is a top plan view of the die used to form the foldable blank as shown in FIG. 2.
Figure 8:
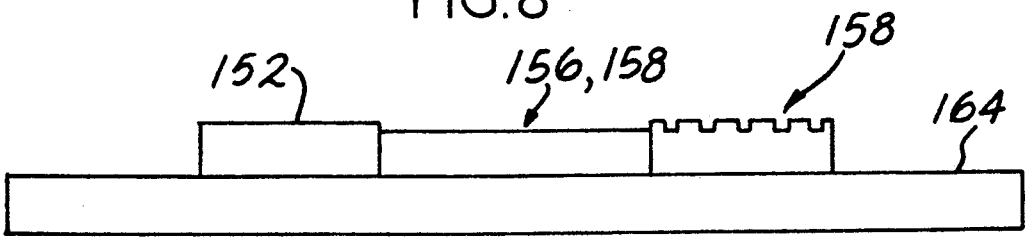
FIG. 8 is a side elevational view of the die shown in FIG. 7 having a plurality of combined techniques of slitting, scoring and perforating utilized.

In operation, the slitting, scoring and perforal rules are placed on a die chase or base portion 164 which is subsequently locked on the bed of a press. In opposed relation to the chase is a platen (not shown) to provide pressure against the rule members during operation. The matrix tape 162 is first placed upon the associated rules with which they are to be used as shown in FIG. 7 and subsequently the platen is brought into place such that the matrix tape is secured with the platen at the proper location relative to the rules. A sheet of material may then be placed between the rules and the platen with the matrix tape adhered thereon and a force applied such that the slitting rules will cut out blanks as described and the perforal rules will provide the desired fold lines in the blank. The die may be utilized on a cylinder or flat base and may comprise a plurality of nested dies to form a plurality of blanks during one manufacturing cycle.

The precision of the lay out of the die members of die 150 is extremely important to provide proper assembly of the enclosure so that the elements which will constitute the top of the enclosure readily fold over the side elements so as to retain the side elements in a secured closed position. Preferably, the tolerances of the die areas are formed by laser techniques to ensure proper manufacturing and sharp properly positioned fold lines.

Although there has been illustrated and described what is at present considered to be a preferred embodiment of the present invention, it will be appreciated that numerous changes and modifications are likely to occur to those skilled in the art. For example, the die of the invention may be constructed so as to form fold lines in the blank used to form the enclosure such that the blank can be folded reversibly such that different material on alternate sides of the blank may be used on the outside of the enclosure as desired. Other changes or modifications are likely to occur to those skilled in the art, and the scope and true spirit of the invention is not limited by the disclosure but only as set forth in the appended claims.

What is claimed is:

1. A container assembly formed from a unitary blank of foldable sheet material comprising, a bottom wall bounded by first, second, third and fourth side walls wherein said first and third side walls and said second and fourth side walls are positioned in diametrically opposed relationship;

said side walls being flexibly coupled to said bottom wall by first type fold lines to enable positioning of said side walls in an upstanding relationship to said bottom wall;

said first and third side walls being flexibly coupled to said second and fourth side walls by bellows-type coupling means acting to draw the respective side walls to adjacent positions when in their upstanding positions;

said bellows-type coupling means flexibly coupled to said side walls by said first type fold lines and having a second type of fold line which is more easily manipulated than said first type of fold line formed therein so as to enable inward folding of said bellows-type coupling means during assembly; and first, second, third and fourth top walls being flexibly coupled to said first, second, third and fourth side walls respectively, at positions diametrically opposed from said bottom wall, wherein at least two opposed top walls have dimensions so as to extend in slight overlapping relationship when folded toward one another, and the other two of said top walls have dimensions so as to extend over at least half of the width of said bottom wall;

said top walls being flexibly coupled to said side walls by said first type of fold lines to enable said top walls to be folded to spaced apart substantially parallel positions relative to said bottom wall, wherein when said container is formed, the said second type of fold lines are first folded in said bellows-type coupling means so as to draw the respective side walls to an upstanding position facilitated by said first type of fold lines flexibly connecting said side walls with said bottom wall, said top walls being subsequently folded down so as to form a fully enclosed container.

2. A container assembly as in claim 1, wherein said first type fold lines are scored indentations forming weakened zones which will readily fold upon application of a sufficient amount of pressure thereto but which retain an amount of strength to facilitate handling of the unitary blank material from which said container is formed.

3. A container assembly as in claim 1, wherein said second type of fold lines are perforated fold lines thereby forming substantially weakened zones which are easily inwardly creased as a first step during assembly of said container.

4. A container assembly as in claim 2, wherein said scored indentations are formed as forwardly scored fold lines around said side and bottom walls, and reverse scored cupped fold lines at said top walls.

5. A container assembly as in claim 2, wherein said scored indentations are formed from a relatively narrow matrix tape around said top and said walls and a relatively broad matrix tape around said bottom wall.

6. A container assembly as in claim 1, wherein said bellows-type coupling means are formed as rectangular panels having a similar width to that of said side walls and are bisected by said second type fold lines from a position adjacent said bottom wall towards an outer uncoupled corner thereof.

7. A container assembly as in claim 1, wherein said blank from which said container is constructed is adapted to be printed on one or both sides thereof to form a decorative assembly.

8. A container assembly as in claim 1, wherein said bellows-type coupling means are inwardly folded and initially positioned so as to support and reinforce said top walls when said top walls are in said spaced apart substantially parallel positions relative to said bottom wall.

9. A container assembly as in claim 1, wherein said side and top walls form an enclosed storage volume when in their respective upstanding and substantially parallel positions relative to said bottom wall, and said bellows-type coupling means are inwardly folded to the interior of said volume and initially positioned at an inwardly extending angle relative to at least one of said side walls, such that said bellows-type coupling means limit said storage volume dependent upon said inwardly extending angle and wherein said bellows-type coupling means may be physically moved from said initial inwardly extending angle towards an adjacent one of said side walls to vary the limitation of said storage volume thereby.

10. A container assembly as in claim 1, wherein said blank from which said container is constructed is assembled by use of folding jig comprising a plurality of upwardly extending posts positioned on a support base so as to contact the bellows-type coupling means at said second type fold lines to enable inward folding thereof and acting to draw up the respective side walls to their upstanding positions to facilitate easy and efficient assembly of said container regardless of its size.

11. A container assembly as in claim 1, wherein, said at least two opposed walls are configured to allow all of said top walls to be exposed adjacent the position at which said at least two opposed top walls slightly overlap to allow securing of each of said top walls to at least one adjacent top wall when folded to said substantially parallel positions relative to said bottom wall.

12. A container assembly as in claim 7, wherein, printing on one or both sides of said blank of foldable sheet material is registered in predetermined relationship relative to at least one of said first type of fold lines.

13. A container assembly as in claim 1, wherein, said blank of sheet material comprises a lightweight paper material.

14. A container assembly formed from a flat blank of foldable sheet material comprising;

a bottom wall bounded by four side walls and being flexibly coupled to each of said side walls by a first type fold line which allows said side walls to be positioned in upstanding relationship with respect to said bottom wall while maintaining the integrity of said sheet material;

each of said side walls being coupled to adjacent side walls by bellows-type coupling means, which are flexibly coupled to adjacent side walls by said first type fold lines;

said bellows-type coupling means having a second type of fold line formed therein so as to enable inward folding of said bellows-type coupling means, wherein said bellows-type coupling means act to draw the respective side walls to adjacent upstanding positions relative to said bottom wall;

four top walls flexibly coupled to each of said side walls by said first type of fold line to allow said top walls to be folded into spaced apart, substantially parallel positions relative to said bottom wall, wherein at least two of said top walls will slightly overlap to form a closed container but remain free from direct connection to one another.

* * * * *